US005971105A

United States Patent [19]

Jacobson

[11] Patent Number: 5,971,105

[45] **Date of Patent: *Oct. 26, 1999**

[54] ESCAPE LADDER

[76] Inventor: Harold Jacobson, 2057 Blue Spring Rd., West Palm Beach, Fla. 33411

[ * ] Notice: This patent issued on a continued prosecution application filed under 37 CFR 1.53(d), and is subject to the twenty year patent term provisions of 35 U.S.C. 154(a)(2).

[21] Appl. No.: 09/048,466

[22] Filed: Mar. 26, 1998

[51] Int. Cl.[6] ..... E06C 1/52

[52] U.S. Cl. ..... 182/198; 182/70; 182/76; 182/93; 182/196; 182/197

[58] Field of Search ..... 182/70, 76, 95, 182/96, 163, 764, 196, 197, 198, 199, 93

[56] References Cited

U.S. PATENT DOCUMENTS

| | | | |
|---|---|---|---|
| 192,364 | 6/1877 | Duncan . | |
| 242,716 | 6/1881 | Thompson . | |
| D. 363,037 | 10/1995 | Navarez et al. | D10/114 |
| 433,061 | 7/1890 | Aarons | 182/76 |
| 1,196,419 | 8/1916 | Banyovits | 182/76 X |
| 2,990,908 | 7/1961 | Wozniak . | |
| 3,077,241 | 2/1963 | Klages | 182/196 |
| 3,677,366 | 7/1972 | Loeffel | 182/164 X |
| 3,875,602 | 4/1975 | Miron | 9/8.3 R |
| 4,189,030 | 2/1980 | Leslie et al. . | |
| 4,243,121 | 1/1981 | Kiss et al. | 182/196 |
| 4,442,920 | 4/1984 | Gronbeck et al. | 182/199 |
| 4,445,589 | 5/1984 | Longenecker . | |
| 4,471,854 | 9/1984 | Heilskov | 182/196 |
| 4,554,996 | 11/1985 | Salvarezza | 182/199 |
| 4,852,688 | 8/1989 | Strohmeyer, Sr. | 182/70 X |
| 5,446,629 | 8/1995 | Steiger et al. | 362/34 |
| 5,467,841 | 11/1995 | Krumal . | |

FOREIGN PATENT DOCUMENTS

| | | | |
|---|---|---|---|
| 2230813 | 10/1990 | United Kingdom | 182/196 |
| 2262958 | 7/1993 | United Kingdom | 182/76 |

*Primary Examiner*—Daniel P. Stodola
*Assistant Examiner*—Richard M. Smith
*Attorney, Agent, or Firm*—McHale & Slavin PA

[57] ABSTRACT

An escape ladder stored in an interior wall of a building, beneath a window. The ladder is deployed by placement through a window with a storage container providing a step for ease in exiting. Ladder steps are secured by a flexible strap with each step including an integral spacer to maintain proper positioning of the steps upon deployment. The ladder is stored in a nest configuration pattern with the connecting strap folded between each step.

18 Claims, 3 Drawing Sheets

ESCAPE LADDER

FIELD OF THE INVENTION

This invention relates to ladders for use in exiting a multi-story building and more particularly to an improved escape ladder having a space saving step nesting structure that allows for a compact permanent installation in a wall cavity beneath a window.

BACKGROUND OF THE INVENTION

Escape ladders are well known in the art. Such devices allow individuals in a multi-story building to safely leave through a window should a conventional exit route be blocked. The use of escape ladders date back to 1865 wherein U.S. Pat. No. 50,596 disclosed an escape ladder constructed from rope and stored in a cabinet. The escape ladder was deployed by removing it from the cabinet and placing it through a window opening. An upper end of the ladder was secured to the window and the remainder of the ladder was available for an individual to safely escape.

U.S. Pat. No. 192,364 disclosed an escape ladder constructed from rope having cylindrical rods inserted operating as steps. This ladder is also stored in a storage container mounted beneath a window. A problem with this disclosure, and the above captioned ladder device, is that each device may impact the side of a building once deployed. Such a placement may cause an individual difficulty during an escape procedure since the individual must attempt to pull the ladder away from the building in order to place their feet onto a step. Should the ladder move, the individual could injure their feet, if barefoot, or knock their feet off the steps. Similarly, an individual's fingers could be crushed against the wall should excessive weight be on the ladder, such as when another individual is using the ladder at the same time.

U.S. Pat. No. 242,716 discloses an escape ladder that employs a bracket at the top of the ladder which positions a portion of the ladder away from the wall. However, no provision is made for maintaining the individual steps away from the wall. In addition, the ladder is stored inside a large space consuming box positioned in front of the window. Further, a ceiling hook is required for proper positioning of the ladder upon deployment.

U.S. Pat. No. 443,061 discloses a wire chain ladder having a storage container formed integral to the wall. This patent addresses the finger pinching problem by employing spacers to position the ladder a distance from the wall. However the support chain is unpleasant to handle, is heavy, subject to kinking, and cannot be easily stored.

U.S. Pat. No. 2,990,908 discloses yet another fire escape ladder having a storage container placed in front of a window. The disclosure is similar to the prior devices art with the patent directed to the use of a knot placed before and after each rung for proper positioning. Mass production of such a device requiring proper placement of said knots is not practical.

U.S. Pat. No. 4,189,030 discloses a collapsible ladder formed from a web material. The web material is placed through a T-slot on each step and is secured to the web material by allen screws, the screws providing the sole means for attachment. For deployment, the ladder is hung from a hook secured to the top of the window. There is no provision for inhibiting an individual from placing their entire foot on each step thereby allowing an individual to crush toes or be knocked off from the step. The use of individual hand hold slots are difficult to locate during an emergency and can easily trap fingers inserted too deeply.

U.S. Pat. No. 4,445,589 discloses a fire escape ladder that is integrated into a window frame assembly. The window opens outward to reveal a concealed storage area which houses the ladder on the outside of the building. The device requires a window of a particular design having to accommodate the window and ladder storage compartment.

U.S. Pat. No. 5,467,841 discloses yet another fire escape ladder integrated into a window frame assembly. As with the previously mentioned patent, the window is required to rotate outward for deployment of the ladder. However, the problem with outward deployment is that any expansion of the window frame will inhibit rotation. This movement may further be inhibited by paint accumulation on the window frame. Should an escape be necessary during cold weather, frame contraction may also inhibit movement, as well as snow or ice formation.

Thus what is lacking in the art is an escape ladder that provides for nearly an instant deployment by positioning directly beneath a window, does not consume any floor space, provides a means for protecting an individual's toes and fingers from impacting a wall during an escape procedure, and is simply in usage so as to allow deployment despite confusion or panic.

SUMMARY OF THE INVENTION

The instant invention is an escape ladder that fits compactly within a storage container directly beneath a window. The storage container is sized for positioning between two wall studs allowing the ladder to be stored in a position flush with an interior wall surface. A cover to the storage container can be made aesthetically pleasing, include appropriate indicia, and may be concealed by conventional window treatment.

The escape ladder employs wide rigid steps supported by a pair of flexible webbing strips to minimize rotation and/or tipping of the steps. The steps are constructed from a fire resistant material, such as aluminum or a modified plastic. Each step includes an angled projection that operates as a spacer to provide toe and finger protection. For instance, while an individual is climbing down the ladder, the spacer allows an individual to place the ball of their foot directly onto the step surface. When the ladder swings and impacts the wall, the spacers will prevent the individual's foot from being knocked off the step, as well as prevent their toes from being crushed. Similarly, the spacer allows an individual to grasp the step during descent and prohibits a main portion of the step from impacting the wall protecting the fingers. Thus, in a panic situation, the individual attempting to escape may grasp either the webbing or the step during the decent.

The ladder assembly is nested within the storage container and in the event of an emergency, the cover and the ladder placed through the window where gravity will allow the ladder to deploy. A vertical or horizontal pin placement maintains the webbing to each step wherein a clamp forces the strap to fold inwardly during storage. Each step nests onto an adjoining step forming a storage position that allows for ease of installation and removal.

Thus an objective of the instant invention is to disclose an improved fire escape ladder having a storage container that can be mounted flush or recessed to the interior wall of a building, beneath a window.

Yet another objective of the instant invention is to disclose a ladder assembly having a strap clamp that frictionally engages each step to assist in preventing entanglement and for creating a natural fold line for storage purposes.

Still another object of the instant invention is to disclose a storage housing that doubles as a step for assisting an individual in exiting a window during an escape procedure.

Yet still another object of the instant invention is to disclose the use of nestable steps to allow compact storage and permit movement of the steps as a single assembly.

Still another object of the instant invention is to disclose a step with integral spacers for proper positioning of each step from a wall surface once deployed.

Other objects and advantages of this invention will become apparent from the following description taken in conjunction with the accompanying drawings wherein-are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
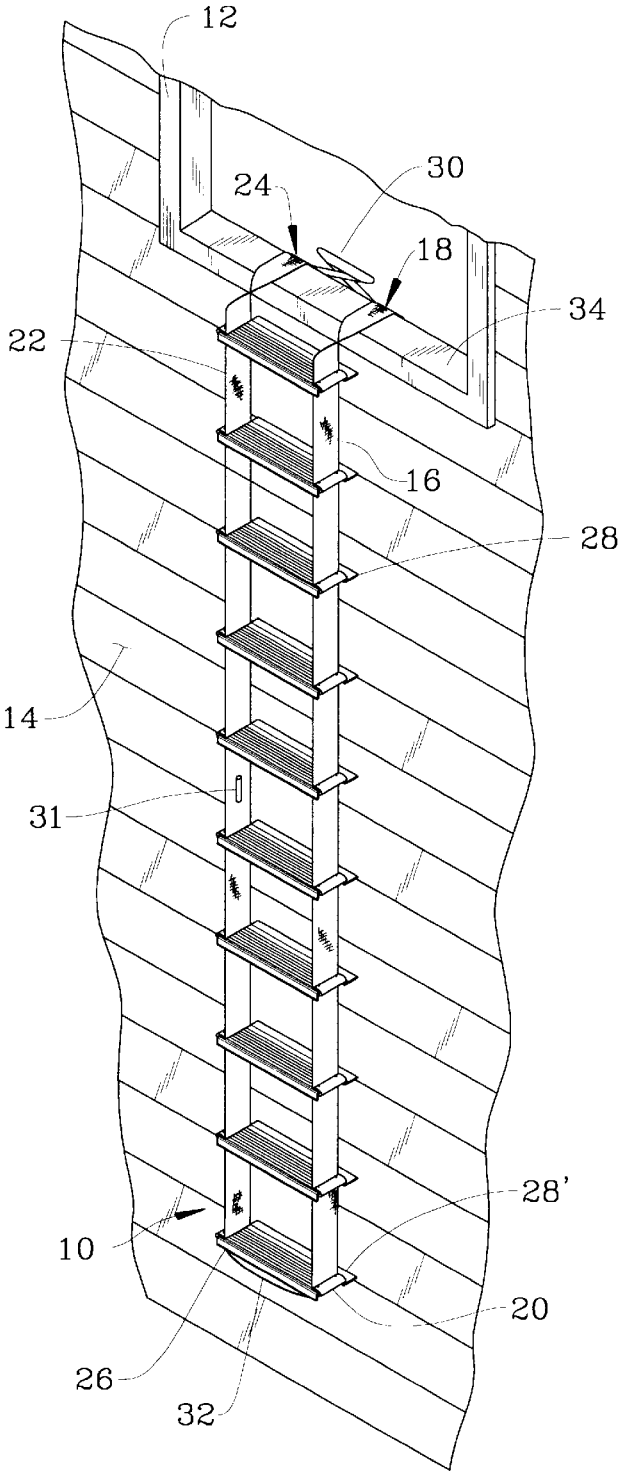
FIG. 1 is a pictorial view of the ladder of the instant invention deployed along the exterior wall of a building.

Now referring to FIG. 1, shown is a pictorial of the escape ladder 10 of the instant invention extending through a window 12 along the side of building 14. The escape ladder 10 is formed from a first flexible web strap 16 which has a proximal end 18 secured to the building and distal end 20 which spans the length of the structure, namely the distance between the window opening and the ground. It should be noted that the ladder need not reach the ground since most every individual may safely jump a few feet without injury. A second flexible web strap 22, forms a mirror image to the first strap and includes a proximal end 24 and a distal end 26, plurality of steps 28 is coupled between the first and second strap. At the proximal end of each of the straps is a handle 30 providing a hand hold location as an individual positions their feet on the individual steps 28. The length of the straps 16, 22 are dependent upon the height of the window in relation to the ground. Similarly, the number of steps 28 is dependent upon the distance between the window and the ground. On a multi-story building, the steps 28 may be spaced apart which still allows for ease of use yet does not consume exorbitant storage area while in a storage position. The top step is preferably positioned a distance form the storage container so as not to inhibit exiting through the window yet allow an individual to reach the first step once the individual's leg is placed over the window sill.

As will be described in more detail later in the specification, the escape ladder is held within a storage container placed beneath a window and integrated into a wall. In the event of an emergency, a cover panel is removed allowing access to the ladder. The hand hold 32 located beneath the lowest step 28' is pulled and thrown over the window-sill 34 where gravity allows the ladder to unfold as shown in its abutment against wall surface 14.

The strap or webbing is preferably formed from a textile polyester having an approximate width of 48.5 millimeters and a thickness of 1.22 millimeters. The webbing has a breaking strength of approximately (6700) sixty-seven hundred pounds and conforms to the motor vehicle safety standard No. 302 regarding the flammability of material. The polyester is highly resistant to burning. Additionally, an insulating protective sleeve may be placed over the webbing placed through the window sill. This sleeve can further enhance the webbing strength when subjected to high temperatures. A chemiluminescent light stick 31 may be attached to an inner or outer side surface of the webbing. The light is self activating upon deployment of the ladder and will serve to illuminate that a ladder has been deployed.

Figure 2:
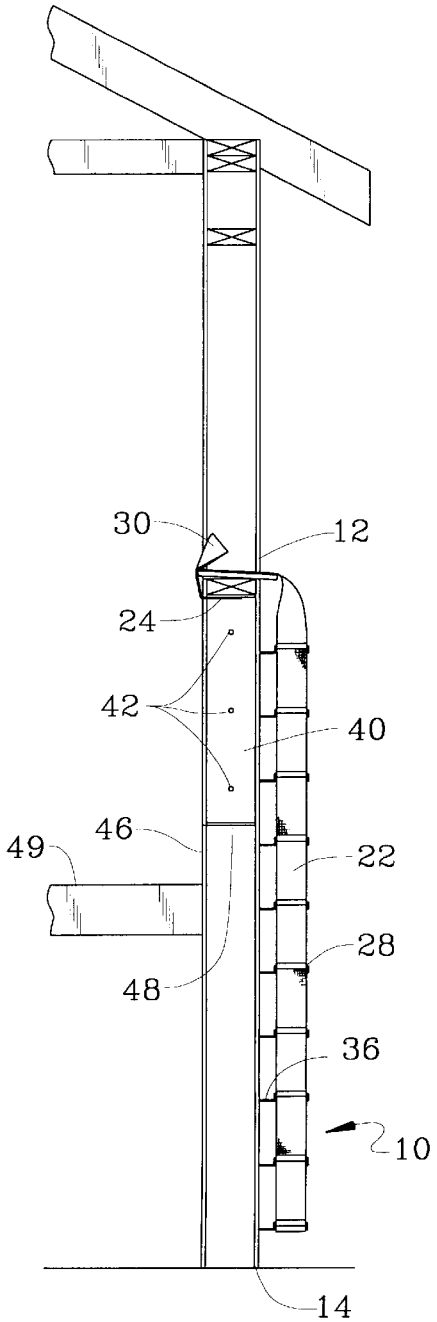
FIG. 2 is a partial side view of the ladder and storage container assembled in a building.

Referring now to FIG. 2, ladder 10 is shown abutting wall 14. The individual steps 28 are spaced apart from the wall 14 by an integral spacers 36 which maintain the straps 16 and 22 at a fixed distance apart from the wall surface. The storage container 40 shown is placed within the window-sill 12 with proximal end 24 of strap 22 coupled to the upper portion of the container 40. The storage container 40 is preferably bolted between two studs using bolt holes 42. As previously described the storage container houses the ladder 10 in a collapsed position wherein each step is situated on top of the other, straps 22 and 16 are folded over each other. The storage of the ladder 10 within the compartment 40 allows the interior wall surface 46 to remain flush. The floor 49 is not obstructed in front of the window-sill 12. This allows use of regular window treatment and avoids consuming of any floor space 49 or otherwise blocking of the window 12. In addition, the bottom 48 of the storage container 42 provides a step allowing individuals to climb onto the window-sill during an escape procedure. This is especially useful when a window-sill is higher than normal.

Figure 3:
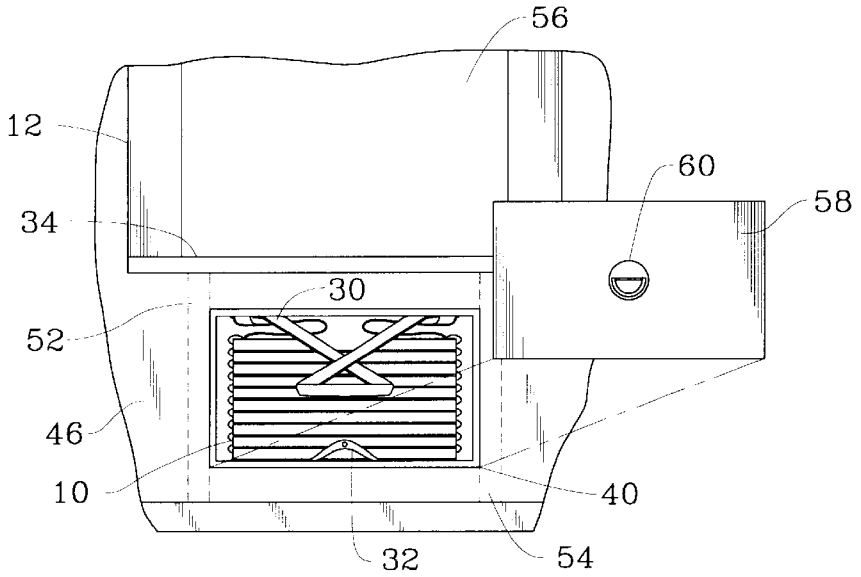
FIG. 3 is a front view of a storage container with a stored ladder assembly with cover removed.

Now referring to FIG. 3, shown is the inside wall 46 of a building having window 12 and window-sill 34. The storage container 40 is shown mounted between studs 52 and 54. The ladder assembly 10 is stored within the container 40 with handle 32 available at the bottom of the ladder assembly for ease of deployment. The ladder is stored in a nested mode and can be temporarily moved as a full nested stack for initial mounting of the container. In this manner, the nesting steps can be secured together by use of a VELCRO or adhesive tape.

The handle 32 is placed through the window opening 56 over the window-sill 34 and the ladder fed through the window until fully deployed. The handle 30 is again illustrated at the top of the storage container 40. Cover 58 secures to the storage container by the use of spring clips, snaps, hook & pile (Velcro), magnets, or adhesive tape attachment that allows for ease of removal. Preferably the cover 58 conforms to the color of the interior wall 46 with a separate handle 60 for ease of grasping the cover 58. The cover will include an emergency identification logo, such as a fireman's helmet. The logo is preferably a red night-glow pigment and/or a reflective logo.

Figure 4:
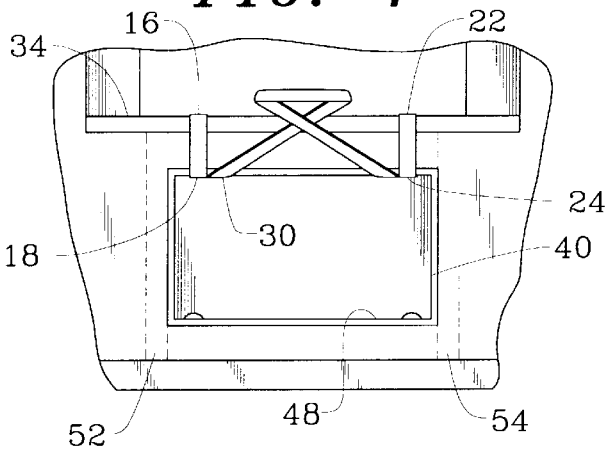
FIG. 4 is a front view of the storage container with the ladder deployed.

Now referring to FIG. 4, upon deployment the storage container 40 is empty with the bottom 48 available for use as a step. Straps 22 and 16 are shown placed over window-sill 34 with proximal ends 18 and 24 securing the straps directly to the top of the storage container 40. Handle 30 is similarly secured to the storage container. The container requires positioning between the studs 52 and 54, no further securement of the ladder assembly is necessary. The storage container is preferably constructed from a heavy gauge sheet metal suitably formed with an array of knockout holes for various mounting situations. The metal is coated with a powder coating for corrosion resistance and appearance enhancement.

Figure 5:
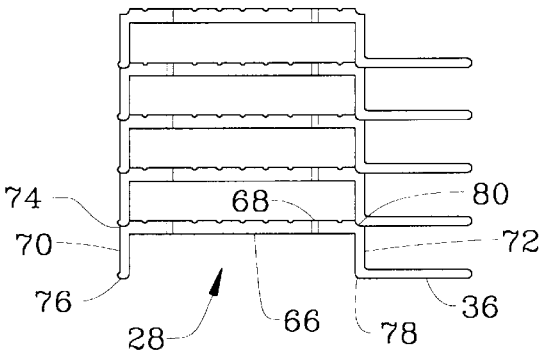
FIG. 5 is a side view of a few nested steps.
Figure 5A:
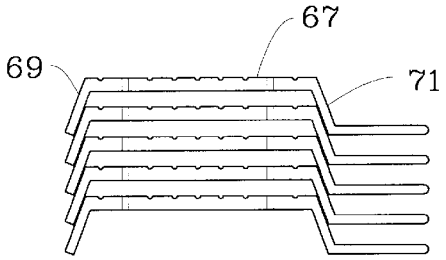
FIG. 5A is a side view of an alternative embodiment of nesting steps.

FIG. 5, depicts steps 28 stacked on top of each other without the webbing so as to illustrate the nesting of the steps. Step 28 is a substantially rectangular shape with a bottom surface 66 an upper surface 68 a first wall 70 and a second wall 72. The first wall 70 has an upper portion with a curvature 74 which is operatively associated with the lower end 76 of an adjoining step. The lower end 76 has a shape so as to conform and nest within the receptacle formed by the upper end 74. Similarly side 72 has a bottom end 78 and an upper end 80 wherein the bottom end nests within the upper end 80 of an adjoining step. The nesting allows the steps to be stored in a solid attachment for ease of manufacturing, shipping, and storage providing a compact design with sufficient space for placement of the webbing between the lower surface 66 and upper surface 68 of an adjoining step. As previously mentioned, extension 36 operates as a spacer against the wall with the outer surface of end wall 72 forming a wall spacer. FIG. 5A depicts an alternative embodiment wherein the steps 67 may be compactly stored by angle formation of side walls 69 and 71.

Figure 6:
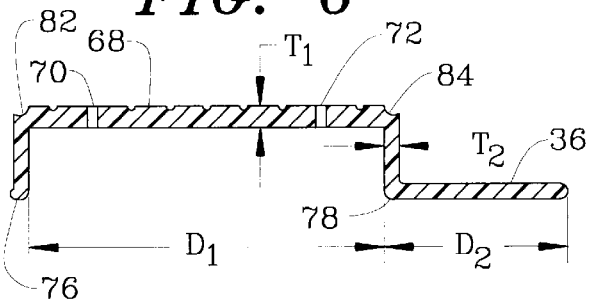
FIG. 6 is a side view of a step having a vertical fastener.

Referring now to FIG. 6 set forth is step 28 having a depth $D_1$ of approximately 1.96 inches with a spacer flange depth $D_2$ of approximately 1.125 inches. The thickness $T_1$ is approximately 1/16 of an inch which provides adequate strength for various types of materials that could be used. For instance, the step may be formed from plastic, aluminum, or any other rigid material having an ability to resist fire. The thickness $T_2$ may be less than $T_1$ as it is not required to carry the load of the foot and operates to stiffen the step as well as operate as a spacer support for spacer section 36.

Figure 7:
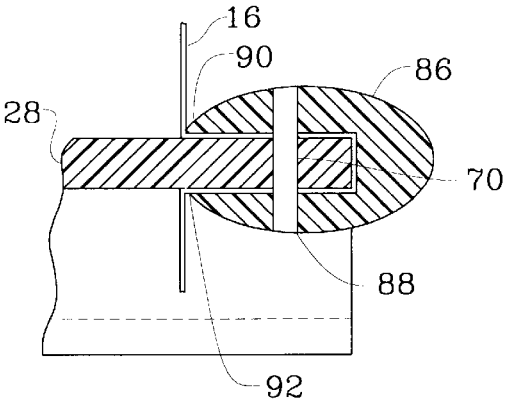
FIG. 7 is a vertical step attachment clamp.

Now referring to FIG. 7, webbing 16 is secured to the step by use of connector 86. The connector fits over the end of the step and employs an aperture 88 which aligns with aperture 70 of the step. A rivet is inserted through the web coupling in the aperture to maintain the webbing in a fixed position. It is noted that the stress on the webbing is distributed as it wraps around the step by entering through end 90 of coupling 86 and exiting at end 92 of coupling 86. The positioning of the webbing and any weight placed on the steps further secure the coupling to the step. The rivet is passed through aperture 70 and 88 maintaining the coupling in relation to the step. The result is a minimum force exertion on the coupling allowing the step to maintain the majority of the load. In addition, the holes required for the aperture are minimal and necessary only to keep the coupling in position, the webbing is not relying upon the apertures for structural support.

Figure 8:
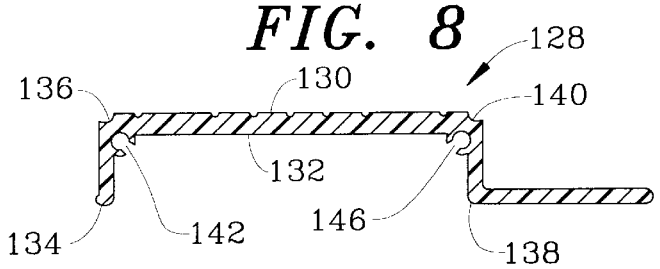
FIG. 8 is a side view of a step having a horizontal axial fastener.
Figure 9:
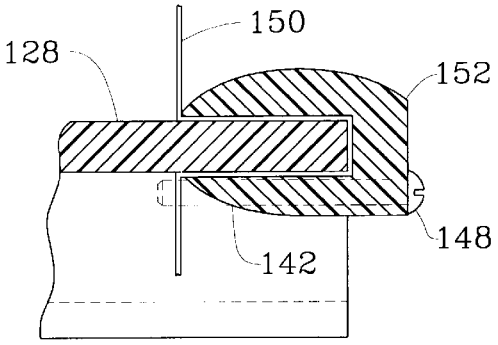
FIG. 9 is a horizontal step attachment clamp.

Referring now to FIG. 8, shown is another embodiment of the step mounting mechanism having an upper surface 130 and a lower surface 132. The first end 134 is operatively associated with receptacle 136 on an adjoining step. Similarly end 138 is operatively associated with receptacle 140 on a separate step. In this embodiment the coupling is provided by attachment holes 142 and 146 formed integral with the step. As shown in FIG. 9 the hole is receptive to mounting bolt 148 wherein strap 150 wraps around the step 128 with coupling bracket 152 maintaining the strap in position. Coupling bolt 148 extends through mounting hole 142 for maintaining the bracket in position.

Figure 10:
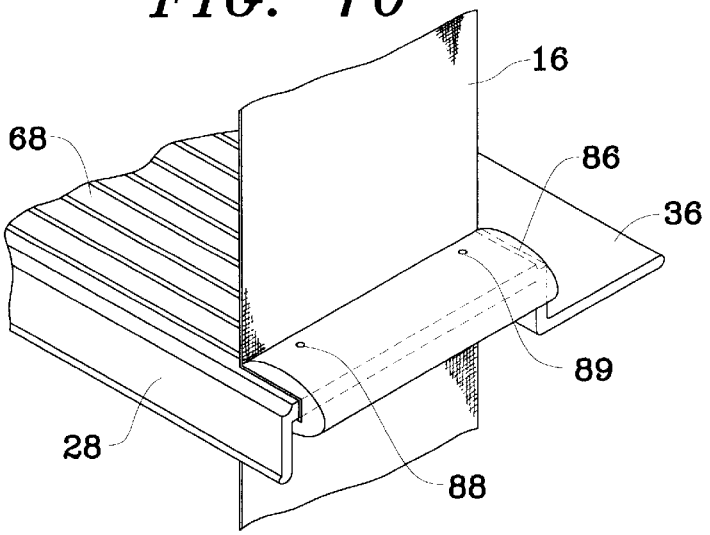
FIG. 10 is a perspective view of a step having a vertical attachment clamp for securing of a strap.

As shown in FIG. 10 the first embodiment of mounting mechanism with step 28 having webbing 16 wrapped around the end of the step with brackets 86 maintaining the bracket in position. Aperture 88 and 89 are available for insertion of rivets so as to maintain the bracket 86 in a fixed position. The upper surface 68 has a number of grooves placed therein which further allow for the firm positioning of a foot during an escape procedure. As previously described, the spacer 36 maintains the step in a fixed position away from the wall so as to prevent toes of the individual from being crushed as well as for allowing a hand hold for the individual also preventing their fingers from being crushed but also allowing the ladder step to be grasped in its entirety.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. An escape ladder apparatus for mounting directly beneath a window, said apparatus comprising:

a storage container having a top, a bottom, a back and two sides, said sides spaced apart a width sized for securement between two studs;

a cover releasably securable to said storage container defining a chamber in said container;

a plurality of elongated steps, each step defined by a rectangular support surface defined by a first end and a second end and a front and back edge, said front edge having a first wall depending therefrom, said back edge having a second wall depending therefrom and a spacer formed perpendicular thereto;

a first and second flexible strap each having a length spanning the distance between a storage container mounting location beneath a window on the inside of a building and the ground level beneath said window on the outside of said building, each said strap having a proximal end secured to said storage container with said steps secured between said straps along the length thereof, said first strap having a plurality of step-end-engaging portions each wrapped around said first end of a corresponding one of said plurality of steps, said second strap having a plurality of step-end-engaging portions each wrapped around said second end of a corresponding one of said plurality of steps;

a plurality of C-shaped clamps each having a channel sized to frictionally engage an end of each step with said strap positioned between said step and said channel, each of said clamps constructed and arranged to maintain a corresponding step-end-engaging portion of one of said straps in a weight-distributing orientation with respect to a corresponding step; said weight-distributing orientation forcing said step-end-engaging portion to simultaneously extend in a substantially conforming manner along a top portion of a corresponding end of said corresponding step, a side portion of said corresponding step, and a bottom portion of said corresponding step;

means for fastening said clamp to each end of said step;

whereby said C-shaped clamps force said step-end-engaging portions to follow the contours of the interior surface of said clamp channels and the exterior surface of the step ends, thereby transferring weight loads from said straps to said steps, and whereby said steps and said first and second straps are stored within said chamber and available for use as a ladder during an emergency procedure upon removal from said chamber and placement through the adjacent window.

2. The apparatus according to claim 1 wherein said front edge of each said step includes a beveled edge for receipt of a lower portion of said first wall and a back edge of said step includes a beveled edge for receipt of a lower portion of said second wall, whereby said steps can be nested for compact storage.

3. The apparatus according to claim 2 wherein said first wall and said second wall have an equal length and sized to space apart nested steps allowing a portion of strap which connects two steps together to be placed therebetween.

4. The apparatus according to claim 1 wherein said steps are formed from a lightweight metal.

5. The apparatus according to claim 1 wherein said steps are formed from plastic.

6. The apparatus according claim 1 wherein each said strap has a width sufficient to prevent twisting of a step coupled between two of said straps, said width being substantially equal to a distance between said step front edge and said step back edge, approximately 2 inches.

7. The apparatus according to claim 1 wherein said cover includes a handle.

8. The apparatus according to claim 1 wherein said clamp is fastened to said step by at least one fastener placed through an aperture which extends vertically through said clamp and said step.

9. The apparatus according to claim 1 wherein said clamp is fastened to said step by a fastener placed through an axial groove extending horizontally along a bottom surface of said step.

10. The apparatus according to claim 1 including a hand strap fastened to said top of said storage container whereby said hand strap available for grasping by an individual to ease an exit procedure.

11. The apparatus according to claim 1 wherein said spacer is approximately 1 inch wide, whereby said spacer provides a distance between each step and an associated building wall to prevent an individual's fingers or toes from impacting the building wall.

12. The apparatus according to claim 1 wherein said support surface of each step has ridges to inhibit slipping.

13. An escape ladder apparatus for mounting directly beneath a window, said apparatus comprising:

a storage container having a top, a bottom, a back and two sides, said sides spaced apart a width sized for securement between two studs;

a cover releasably securable to said storage container defining a chamber in said container;

a plurality of elongated steps, each step defined by a rectangular support surface defined by a first end and a second end and a front edge and back edge, said front edge having a first wall depending therefrom, said back edge having a second wall depending therefrom and a spacer formed perpendicular thereto, said front edge of each said step is beveled for receipt of a lower portion of a first wall of a nesting step and a back edge of said step is beveled for receipt of a lower portion of a second wall of a nesting step;

a first and second flexible strap each having a length spanning the distance between a storage container mounting location beneath a window on the inside of a building and the ground level beneath said window on the outside of said building, each said strap having a proximal end secured to said storage container with said steps secured between said straps along the length thereof and a width substantially equal to a distance between said step front edge and said step back edge, said first strap having a plurality of step-end-engaging portions each wrapped around said first end of a corresponding one of said plurality of steps, said second strap having a plurality of step-end-engaging portions each wrapped around said second end of a corresponding one of said plurality of steps;

a plurality of C-shaped clamps each having a channel sized to frictionally engage an end of each step with said strap positioned between said step and said channel, each of said clamps constructed and arranged to maintain a corresponding step-end-engaging portion of one of said straps in a weight-distributing orientation with respect to a corresponding step; said weight-distributing orientation forcing said step-end-engaging portion to simultaneously extend in a substantially conforming manner along a top portion of a corresponding end of said corresponding step, a side portion of said corresponding step, and a bottom portion of said corresponding step;

means for fastening said clamp to each end of said step; and a hand strap fastened to said top of said storage container;

whereby said C-shaped clamps force said step-end-engaging portions to follow the contours of the interior surface of said clamp channels and the exterior surface of the step ends, thereby transferring weight loads from said straps to said to said steps, and whereby said steps and said first and second straps are stored within said chamber and available for use as a ladder during an emergency procedure upon removal from said chamber and placement through the adjacent window.

14. The apparatus according to claim 13 wherein said clamp is fastened to said step by at least one fastener placed through an aperture which extends vertically through said clamp and said step.

15. The apparatus according to claim 13 wherein said clamp is fastened to said step by a fastener placed through an axial groove extending horizontally along a bottom surface of said step.

16. The apparatus according to claim 13 wherein said spacer is approximately 1 inch wide, whereby said spacer provides a distance between each step and an associated building wall to prevent an individual's fingers or toes from impacting the building wall.

17. The apparatus according to claim 13 wherein said support surface of each step has ridges to inhibit slipping.

18. The apparatus according to claim 13 including a self activating chemiluminescent light stick securable to said strap.

* * * * *